United States Patent [19]

Patarra

[11] 4,319,590

[45] Mar. 16, 1982

[54] CIGARETTE WITH REMOVABLE SMOKE-MODIFYING CARTRIDGES

[76] Inventor: Sam F. Patarra, 125 NW. 126th St., North Miami, Fla. 33168

[21] Appl. No.: 208,555

[22] Filed: Nov. 20, 1980

[51] Int. Cl.[3] ..... A24D 3/04

[52] U.S. Cl. ..... 131/331; 131/202

[58] Field of Search ..... 131/331, 202, 337, 341, 131/344, 361, 362, 363, 364, 348, 360; 128/285

[56] References Cited

U.S. PATENT DOCUMENTS

| | | | |
|---|---|---|---|
| 1,784,386 | 12/1930 | Poeck | 131/331 |
| 2,345,676 | 4/1944 | Klugherz | 131/202 |
| 2,459,670 | 1/1949 | Morris | 131/331 |
| 3,054,403 | 9/1962 | Baker | 128/285 |
| 3,058,468 | 10/1962 | Griswold et al. | 128/285 |
| 3,324,861 | 6/1967 | Gaisman | 131/10.3 |
| 3,339,557 | 9/1967 | Karalus | 131/4 |
| 3,368,566 | 2/1968 | Avedikian | 131/331 |
| 3,513,859 | 5/1970 | Carty | 131/267 |

FOREIGN PATENT DOCUMENTS

| | | | |
|---|---|---|---|
| 989465 | 4/1965 | United Kingdom | 131/339 |

*Primary Examiner*—V. Millin

*Attorney, Agent, or Firm*—Oltman and Flynn

[57] ABSTRACT

The mouthpiece of a cigarette snugly but slidably receives two cartridges end-to-end, one a filter cartridge and the other a flavor cartridge. Each cartridge has a pull string which enables its removal from the mouthpiece.

6 Claims, 7 Drawing Figures

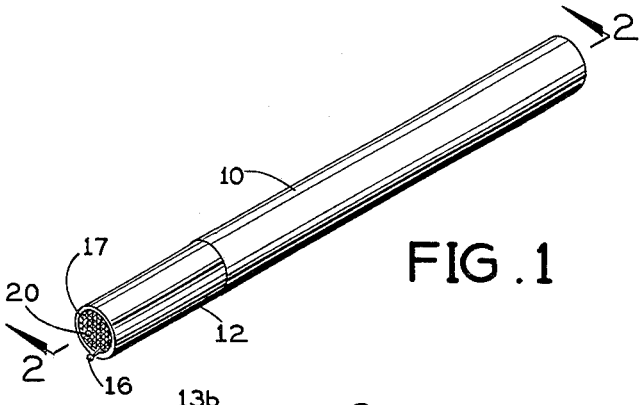
FIG. 1
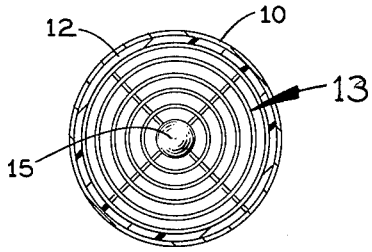
FIG. 3
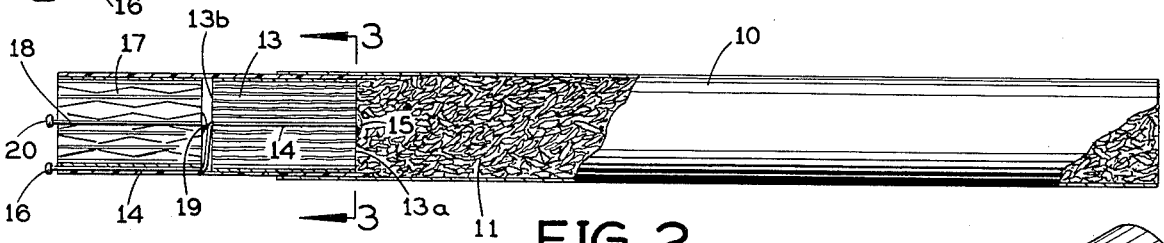
FIG. 2
FIG. 4
FIG. 5
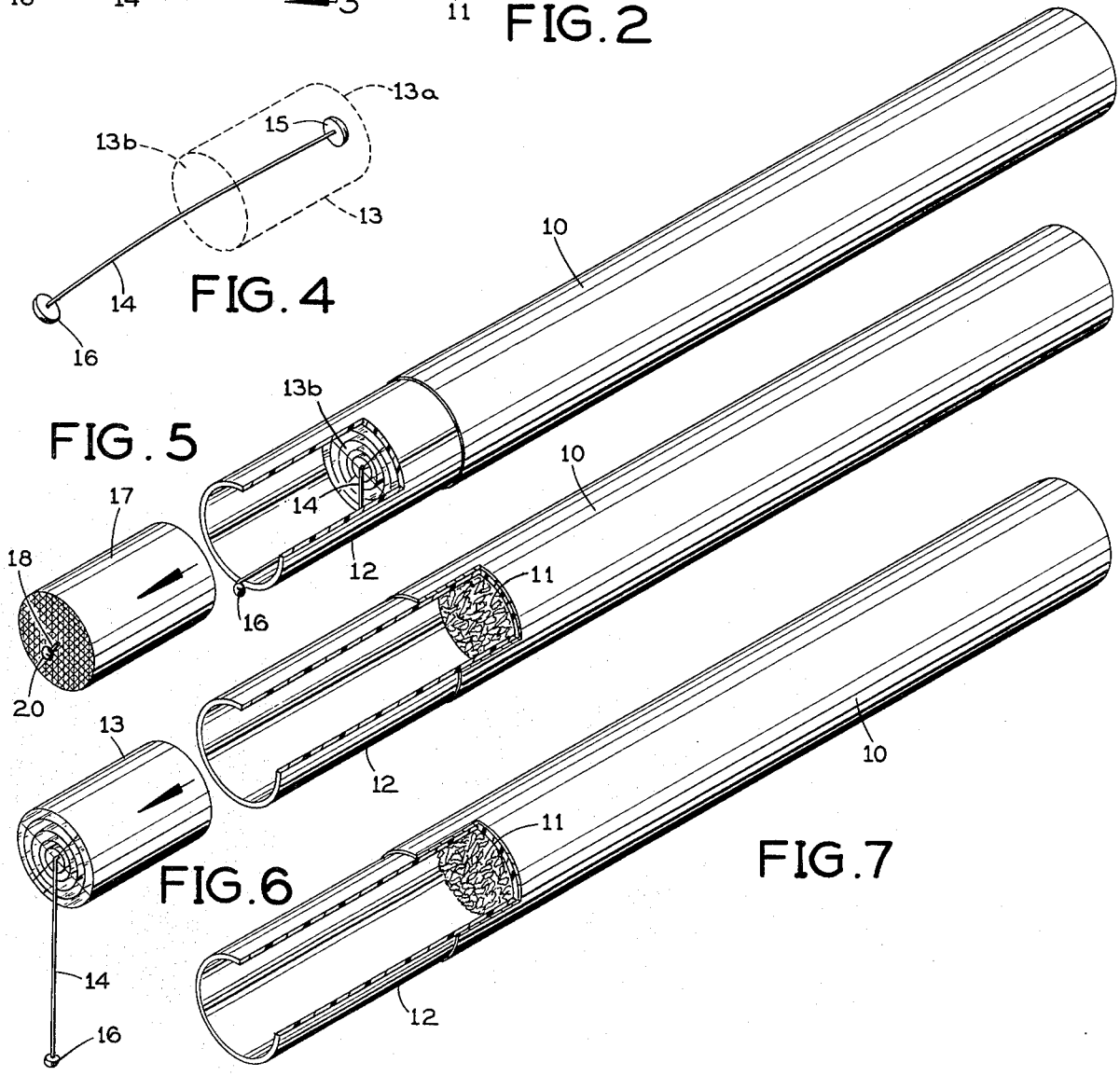
FIG. 6
FIG. 7

CIGARETTE WITH REMOVABLE SMOKE-MODIFYING CARTRIDGES

SUMMARY OF THE INVENTION

This invention relates to a cigarette having a removable smoke-modifying cartridge or cartridges in one end enabling the smoker to select whether to filter or otherwise modify the cigarette smoke.

In the presently preferred embodiment, the present invention comprises:

(1) a smoke-filtering cartridge snugly but slidably received in the mouthpiece or tip of the cigarette and provided with a pull string which extends to the free end of the mouthpiece; and (2) a flavor introducing filter cartridge snugly but slidably received in the mouthpiece just beyond the smoke-filtering cartridge and provided with a pull string which extends to the free end of the mouthpiece.

With both cartridges in place, the cigarette smoke is both filtered and flavored. By removing the flavor cartridge, the cigarette is converted to one providing filtered but unflavored smoke. By pulling out the smoke-filtering cartridge, the cigarette is converted to one providing unfiltered, unflavored smoke, with the tobacco kept away from the smoker's lips.

A principal object of this invention is to provide a novel and improved cigarette having a removable smoke-modifying cartridge or cartridges in its mouthpiece or tip.

Another object of this invention is to provide a cigarette having a mouthpiece or tip which snugly but slidably receives a pair of smoke-modifying cartridges arranged end-to-end, one for filtering the cigarette smoke and the other for flavoring it.

Further objects and advantages of this invention will be apparent from the following detailed description of a presently-preferred embodiment shown in the accompanying drawing.

DESCRIPTION OF THE DRAWING

FIG. 1 is a perspective view of a cigarette in accordance with this invention;

FIG. 2 is a view of the cigarette, partly in side elevation and the remainder in longitudinal section taken along the line 2—2 in FIG. 1;

FIG. 3 is a cross-section taken along the line 3—3 in FIG. 2;

FIG. 4 shows the pull string on one of the smoke-modifying cartridges in the cigarette, the cartridge itself being shown in phantom;

FIG. 5 is a perspective view, with parts broken away for clarity, showing the outer cartridge removed from the cigarette, leaving the inner cartridge in place;

FIG. 6 is a similar view showing the removal of the inner cartridge; and

FIG. 7 is a similar view showing the cigarette after the removal of both cartridges.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

DETAILED DESCRIPTION

Referring to FIG. 2, the cigarette has an elongated tubular wrapper 10 of paper filled with cigarette tobacco 11 and a cylindrical tip or mouthpiece 12 fitting snugly inside one end of the paper wrapper 10 and bonded adhesively to it.

In accordance with the present invention, an inner cylindrical cartridge 13 is snugly but slidably received inside the tip 12, preferably in contiguous end-to-end relationship with the tobacco at this end of the cigarette as shown. The inner cartridge 13 is made of a suitable material for filtering alledgedly harmful ingredients of cigarette tobacco smoke, such as nicotine and tars. For example, it might be made of paper, cellulose or tobacco arranged in the form of a coherent, unitary body. A flexible pull string 14 extends longitudinally through the cartridge 13 at the center and carries a transverse enlargement 15 at its inner end which engages the inner end face **13*a* of the cartridge. The pull string extends across the outer end face 13*b* of cartridge 13 and along the inside of the cigarette mouthpiece or tip 12 to a transverse enlargement or knob 16 on its outer end, which is located just beyond the free end of the mouthpiece 12**.

Also in accordance with the present invention, an outer cylindrical cartridge 17 is snugly but slidably received inside the mouthpiece or tip 12 in contiguous end-to-end relationship with the inner cartridge 13. The outer cartridge contains a volatile flavoring agent which adds a suitable flavor, such as menthol, lemon or cherry, to the cigarette smoke flowing through it. The outer cartridge 17 is a coherent unitary body having a draw string 18 extending longitudinally through it at the center. This draw string has a transverse enlargement or knob 19 on its inner end engaging the inner end face of cartridge 17 and a similar knob 20 on its outer end located just beyond the outer end face of this cartridge.

From FIG. 5 it will be evident that the user may remove the flavor cartridge 17 from the mouthpiece or tip 12 of the cigarette by grasping the knob 20 on its outer end and pulling cartridge 17 to the left. This leaves the inner filter cartridge 13 in place, recessed into the tip 12 in its original position.

As shown in FIG. 6, the filter cartridge 13 may be removed in the same manner by grasping the knob 16 on the outer end of its pull string 14 and pulling it out. This would leave the cigarette in the condition shown in FIG. 7, with the tip 12 empty and keeping the tobacco 11 away from the smoker's lips.

If desired, with the filter cartridge 13 removed from the cigarette mouthpiece on tip 12, the flavor cartridge 17 may be positioned in the open end of the mouthpiece for a flavored but substantially unfiltered smoke.

From the foregoing, it will be evident that the present invention enables the smoker to select among the following smoking conditions: filtered and flavored, filtered and unflavored, unfiltered and flavored, and unfiltered and unflavored.

I claim:

1. In a cigarette with a tubular mouthpiece defining a recess which is open at one end, the improvement which comprises:

a smoke-modifying cartridge snugly received in said recess and slidably removable therefrom through said open end;

and a pull element operatively coupled to said cartridge and extending to said open end of said recess for pulling the cartridge out of said recess;

said pull element being a flexible string extending longitudinally through said cartridge and having a transverse enlargement at the inner end of said cartridge;

a second smoke-modifying cartridge snugly received in said recess in end-to-end relationship with said first-mentioned cartridge, said second cartridge being slidably removable from said recess through the latter's open end;

and a second flexible pull string extending longitudinally through said second cartridge to the open end of said recess, said second pull string having a transverse enlargement at the inner end of said second cartridge.

2. A cigarette according to claim 1, wherein:

one of said cartridge contains means for filtering harmful ingredients from the smoke;

and the other of said cartridges contains means for introducing a volatile flavoring agent into the smoke.

3. A cigarette according to claim 1, and further comprising:

a second smoke-modifying cartridge snugly received in said recess end-to-end with said first-mentioned cartridge, and second cartridge being slidably removable from said recess through the latter's open end;

and a second pull element operatively coupled to said second cartridge and extending to said open end of the recess for pulling said second cartridge out of said recess.

4. A cigarette according to claim 3, wherein:

said second cartridge is positioned in said recess between said first-mentioned cartridge and the open end of said recess;

and said pull element for the first-mentioned cartridge extends along the outside of said second cartridge to the open end of said recess.

5. A cigarette according to claim 4, wherein:

one of said cartridges contains means for filtering harmful ingredients from the smoke;

and the other of said cartridges contains means for introducing volatile flavoring agent into the smoke.

6. A cigarette according to claim 5, wherein each of said pull elements is a flexible string extending longitudinally through the respective cartridge and having a transverse enlargement engaging the inner end of the respective cartridge.

* * * * *